United States Patent [19]

Yamada

[11] 4,092,558

[45] May 30, 1978

[54] LONG DISTANCE DISCHARGE GAP TYPE SPARK PLUG

[75] Inventor: Shigeyasu Yamada, Nagoya, Japan

[73] Assignee: NGK Spark Plug Co. Ltd., Nagoya, Japan

[21] Appl. No.: 841,070

[22] Filed: Oct. 11, 1977

[30] Foreign Application Priority Data

Oct. 19, 1976 Japan ..... 51-125160

[51] Int. Cl.[2] ..... H01T 13/32; H01T 13/52

[52] U.S. Cl. ..... 313/131 R; 313/138; 313/141; 313/143

[58] Field of Search ..... 313/130, 131 R, 138, 313/141, 143; 123/169 EL, 169 E

[56] References Cited

U.S. PATENT DOCUMENTS

| | | | |
|---|---|---|---|
| 2,899,585 | 8/1959 | Dollenberg | 313/130 X |
| 2,900,547 | 8/1959 | Engel | 313/130 |
| 3,295,005 | 12/1966 | Poellet et al. | 313/141 X |
| 3,538,372 | 11/1970 | Terao | 313/131 R |

*Primary Examiner*—Siegfried H. Grimm

*Attorney, Agent, or Firm*—Stevens, Davis, Miller & Mosher

[57] ABSTRACT

A long distance discharge gap type spark plug comprising a center electrode, a porcelain insulator surrounding the center electrode and provided at its lower side with a firing portion made integral therewith and composed of a reduced diameter trunk wall, and a grounded electrode is disclosed. The spark plug comprises a surface gap L formed between the front end of the center electrode and the grounded electrode, a minor air gap $l$ formed between the outer peripheral surface of the firing portion and the grounded electrode and a thickness $t$ of the trunk wall of the firing portion and given by $1.0 \text{ mm} \leqq L \leqq 4.5 \text{ mm}$,
$0 \leqq l \leqq 0.6 \text{ mm}$ and
$0.5 \text{ mm} \leqq t \leqq 0.9 \text{ mm}$, respectively, the surface gap L being determined within a range that satisfies the following conditions $L \leqq 5t + 2.0 \text{ mm}$ when $0.4 \text{ mm} < l \leqq 0.6 \text{ mm}$,
$L \leqq 5t$ when $0.2 \text{ mm} < l \leqq 0.4 \text{ mm}$,
$L \leqq 5t - 1.5 \text{ mm}$ when $0 < l \leqq 0.2 \text{ mm}$, and
$L \leqq 5t - 2.5 \text{ mm}$ when $l = 0$.

3 Claims, 7 Drawing Figures

LONG DISTANCE DISCHARGE GAP TYPE SPARK PLUG

BACKGROUND OF THE INVENTION

1. Field of the Invention

This invention relates to a long distance discharge gap type spark plug comprising a center electrode, a porcelain insulator surrounding the center electrode and provided at its lower side with a firing portion made integral therewith and composed of a reduced diameter trunk wall, the firing portion extending up to near the lower end of the center electrode and exposing the lower end, and a grounded electrode opposed through the trunk wall of the firing portion to the center electrode.

2. Description of the Prior Art

Recently, as a countermeasure for exhaust gases, a thin mixed fuel has been vaporized, and as a result, it has been required to further improve the ignition property of spark plugs. It has been well known that the most effective means of improving the ignition property of the spark plug is to make a spark gap wide. In general, in a conventional spark plug adapted to ignite the fuel mixture in gaseous state, if the pressure in the combustion chamber of the internal combustion engine, which will hereinafter be called as applied pressure, is high, the requirement voltage becomes too high. As a result, it is impossible to make the spark gap long and hence to improve the ignition property.

In the conventional long distance discharge gap type spark plug, an attempt has been made to utilize a firing portion of the porcelain insulator surrounding the center electrode as a back electrode for the purpose of interrupting the spark discharge produced between the center electrode and the grounded electrode and hence of reducing the discharge voltage.

Such kind of the spark plug, however, has the drawback that if a surface gap formed between the front end of the center electrode and the grounded electrode is made long irrespective of the dimension of a minor air gap formed between the outer peripheral surface of the firing portion and the grounded electrode and of a thickness of the trunk wall of the firing portion, the discharge voltage becomes high, thereby inducing a puncture failure extending through the firing portion of the porcelain insulator. As a result, no occurrence of spark discharge is involved along the surface gap and hence degrading the above mentioned back electrode effect.

SUMMARY OF THE INVENTION

An object of the invention, therefore, is to provide a long distance discharge gap type spark plug which can effectively eliminate the above mentioned drawbacks which have been encountered with a conventional long distance discharge type spark plug by determining a surface gap formed between the front end of a center electrode and a grounded electrode relative to a minor gap formed between the outer peripheral surface of a firing portion of a porcelain insulator and the grounded electrode and to a thickness of the trunk wall of the firing portion and which has an excellent ignition property and excellent durability.

A feature of the invention is the provision in a long distance discharge gap type spark plug comprising a center electrode, a porcelain insulator surrounding the center electrode and provided at its side with firing portion made integral therewith and composed of a reduced diameter trunk wall of the porcelain insulator, the firing portion extending up to near the lower end of the center electrode and exposing the lower end, and a grounded electrode opposed through the trunk wall to the center electrode, of the improvement comprising a surface gap L formed between the front end of the center electrode and the grounded electrode and given by $1.0 \text{ mm} \leqq L \leqq 4.5 \text{ mm}$, a minor air gap $l$ formed between the outer peripheral surface of the firing portion and the grounded electrode and given by $0 \leqq l \leqq 0.6 \text{ mm}$, and a thickness $t$ of the trunk wall of the firing portion given by $0.5 \text{ mm} \leqq t \leqq 0.9 \text{ mm}$, the surface gap L being determined within a range that satisfies the following conditions, i.e.

$L \leqq 5t + 2.0 \text{ mm}$ when $0.4 \text{ mm} < l \leqq 0.6 \text{ mm}$, $L \leqq 5t$ when $0.2 \text{ mm} < l \leqq 0.4 \text{ mm}$, $L \leqq 5t - 1.5 \text{ mm}$ when $0 < l \leqq 0.2 \text{ mm}$, and $L \leqq 5t - 2.5 \text{ mm}$ when $l = 0$.

The invention will now be described in greater detail with reference to the accompanying drawings.

DETAILED DESCRIPTION OF THE INVENTION

Figure 1:
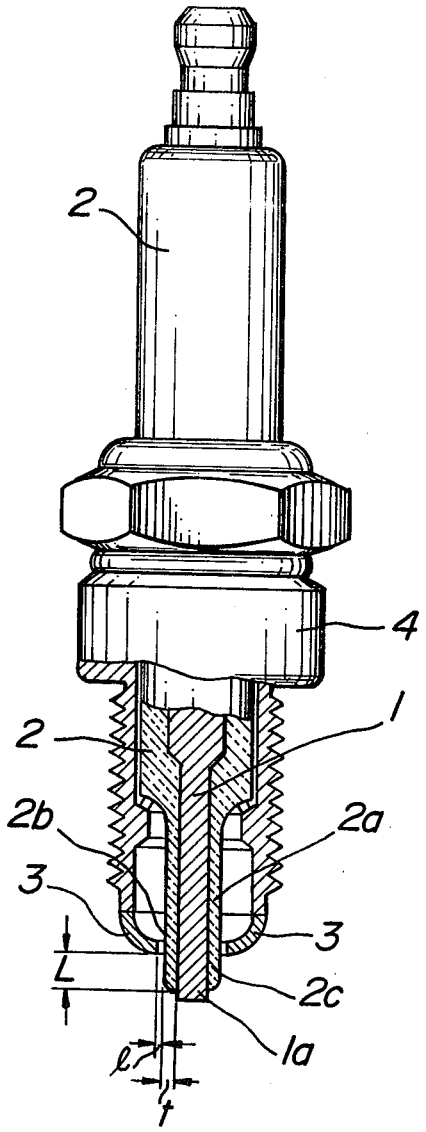
FIG. 1 is a front elevational view of one embodiment of a long distance discharge gap type spark plug according to the invention, main parts being shown in section.

Referring to FIG. 1, reference numeral 1 designates a center electrode and 2 a porcelain insulator surrounding the center electrode 1. The porcelain insulator 2 is provided at its lower side with a firing portion 2*a* made integral therewith and composed of a reduced diameter trunk wall 2*c* of the porcelain insulator 2. The firing portion 2*a* extends up to near the lower end of the center electrode 1 and exposes its lower end 1*a*. The porcelain insulator 2 is projected downwardly from a metal fitting 4 so as to project the firing portion 2a into a combustion chamber (not shown) of an internal combustion engine. To the outer periphery 2b of the firing portion 2a is opposed a grounded electrode 3. The trunk wall 2c of the firing portion 2a functions to separate the grounded electrode 3 from the center electrode 1. The spark discharge produced between the front end 1a of the center electrode 1 and the grounded electrode 3 results in a surface discharge, particularly a flash-over along the surface of the firing portion 2a of the porcelain insulator 2. As a result, the firing portion 2a of the porcelain insulator 2 constitutes a back electrode for reducing the discharge voltage. This is called as a back electrode effect. In such kind of spark plug, if a surface gap L formed between the front end 1a of the center electrode 1 and the grounded electrode 3 and constituting a spark gap is made large irrespective of a minor air gap $l$ formed between the outer peripheral surface 2b of the firing portion 2a and the grounded electrode 3 and of a thickness $t$ of the trunk wall 2c of the firing portion 2a, the discharge voltage becomes high. As a result, there is a risk of that portion of the porcelain insulator 2 which is located near the grounded electrode 3 being punctured and hence no discharge occurs along the surface gap L, thereby degrading the back electrode effect.

Experimental tests have yielded the surprising result that the above mentioned drawback can be eliminated by determining the dimension of the surface gap L for constituting the back electrode with reference to the minor air gap $l$ formed between the outer peripheral surface of the firing portion 2a of the porcelain insulator 2 and the grounded electrode 3 and to the thickness $t$ of the trunk wall 2c of the firing portion 2a.

That is, in accordance with the invention, on the basis of the above experimental test result, the surface gap L is given by 1.0 mm $\leqq$ L $\leqq$ 4.5 mm, the minor air gap $l$ is given by $0 \leqq l \leqq 0.6$ mm and the thickness $t$ is given by 0.5 mm $\leqq t \leqq$ 0.9 mm. In addition, the surface gap L is determined within a range that satisfies the following conditions, i.e.

$L \leqq 5t + 2.0$ mm when 0.4 mm $< l \leqq$ 0.6 mm $L \leqq 5t$ when 0.2 mm $< l \leqq$ 0.4 mm $L \leqq 5t - 1.5$ mm when $0 < l \leqq$ 0.2 mm $L \leqq 5t - 2.5$ mm when $l = 0$ The reasons why the surface gap L formed between the front end 1a of the center electrode 1 and the grounded electrode 3 and extending along the firing portion surface is given by 1.0 mm $\leqq$ L $\leqq$ 4.5 mm are as follows. As seen from FIG. 2, if the surface gap L exceeds the upper limit of 4.5 mm, for example, if $L =$ 6.0 mm, the discharge voltage becomes considerably high, and as a result, provision must be made of a high voltage source and an electric field having a significantly high intensity is subjected to the porcelain insulator 2, thereby inducing a puncture failure extending through the firing portion 2a of the porcelain insulator 2.

On the contrary, if the surface gap L is smaller than the lower limit of 1.0 mm, the ignition ability of the spark plug becomes degraded so that it is impossible to utilize the ability of the long distance gap type spark plug.

Figure 2:
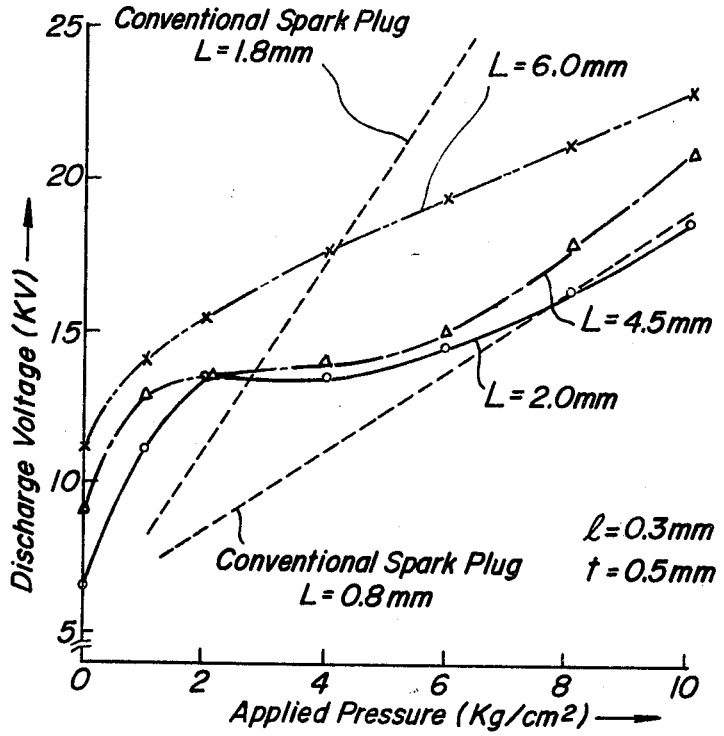
FIG. 2 is an explanatory graph showing the available discharge voltage in accordance with the invention as a function of the applied pressure for various surface gaps with the minor air gap and thickness given.

As shown in FIG. 2 by two dotted line curves, the conventional spark plugs have the drawbacks that the discharge voltage thereof is increased in proportion to the applied pressure.

The reasons why the minor air gap $l$ formed between the outer peripheral surface 2b of the firing portion 2a of the porcelain insulator 2 and the grounded electrode 3 is given by $0 \leqq l \leqq 0.6$ mm are as follows.

Figure 3:
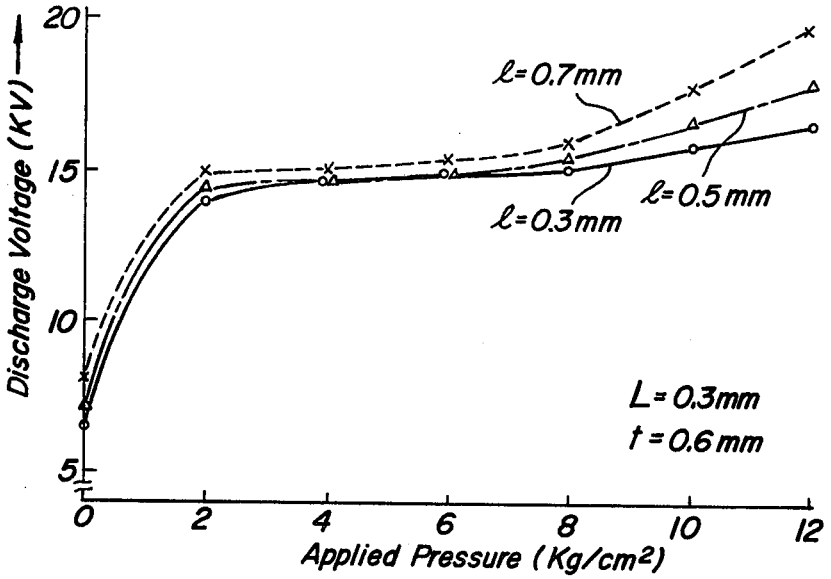
FIG. 3 is an explanatory graph showing the available discharge voltage in accordance with the invention as a function of the applied pressure for various minor air gaps with the surface gap and thickness given.

As shown in FIG. 3, the larger the minor air gap $l$ is the higher the discharge voltage becomes as a function of the applied pressure. In the case of taking the consumption of the grounded electrode 3 into consideration, the minor air gap $l$ of 0.6 mm is its higher limit. On the contrary, if the minor air gap $l$ becomes smaller, the discharge voltage becomes low, but the electric field intensity becomes so high that there is a risk of the firing portion 2a of the porcelain insulator 2 being easily punctured. As a result, it is necessary to make the surface gap L small in accordance with the decrease of the minor air gap $l$ and hence make the discharge voltage low.

Figure 4:
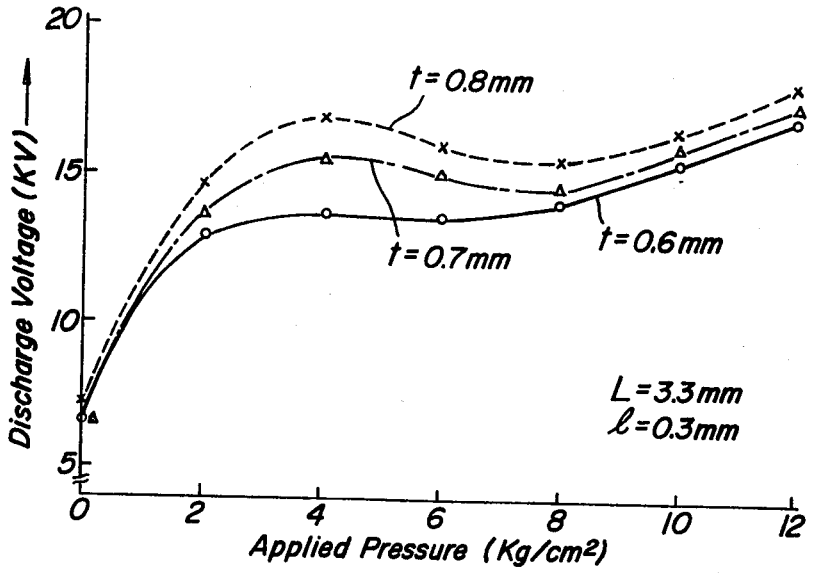
FIG. 4 is an explanatory graph showing the available discharge voltage in accordance with the invention as a function of the applied pressure for various thicknesses with the surface gap and minor air gap given.

The reasons why the thickness $t$ of the trunk wall 2c of the firing portion part 2a of the porcelain insulator 2 is given by 0.5 mm $\leqq t \leqq$ 0.9 mm are as follows. If the thickness $t$ is increased, the puncture failure of the firing portion 2a of the porcelain insulator 2 becomes difficult to be induced, but as shown in FIG. 4, the discharge voltage becomes considerably high under the applied pressure on the order of 3 to 6 kg/cm$^2$. As a result, the upper limit of the thickness $t$ should be 0.9 mm. On the contrary, if the thickness $t$ is smaller than the lower limit of 0.5 mm, the firing portion 2a of the porcelain insulator 2 becomes easily punctured. As a result, it is not preferable to make the thickness $t$ of the trunk wall 2c of the firing portion 2a of the porcelain insulator 2 thinner than the lower limit of 0.5 mm by taking the manufacture and mechanical strength of the porcelain insulator into consideration.

Figure 5:
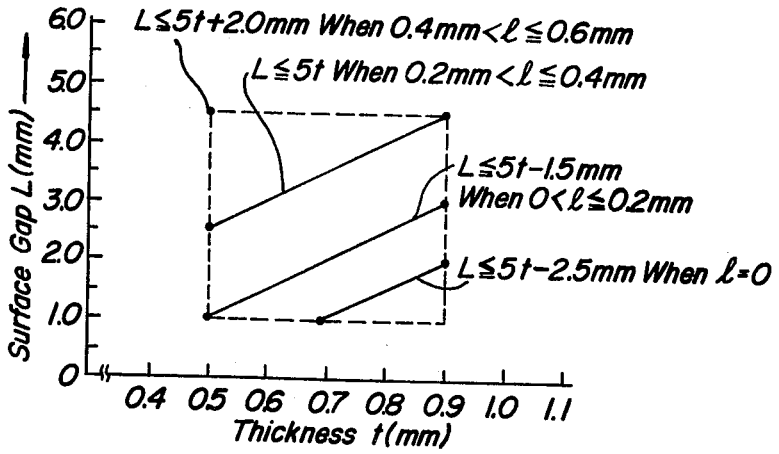
FIG. 5 is an explanatory graph showing the available surface gap in accordance with the invention as a function of the thickness of the trunk wall of the firing portion of the porcelain insulator relative to various minor air gaps formed between the outer peripheral surface of the firing portion and the grounded electrode.

In accordance with the invention, the above mentioned values of L, $l$ and $t$ are mutually related with each other so as to determine the surface gap L that can prevent the puncture failure extending through the firing portion 2a of the porcelain insulator 2. In FIG. 5 showing the surface gap L as a function of the thickness $t$ of the trunk wall 2c of the firing portion 2a, the surface gap L is determined by straight lines representing the conditions that 0.4 mm $< l \leqq$ 0.6 mm, 0.2 mm $< l \leqq$ 0.4 mm, $0 < l \leqq$ 0.2 mm and $l \leqq 0$, respectively. If $l$ is small, the discharge voltage becomes low, but the puncture failure is easily induced. As a result, $t$ must be made thick and the surface gap L can not be made considerably large. For example, when $l = 0$, $t$ is given by 0.7 mm to 0.9 mm and hence the surface gap L becomes 1.0 mm to 2.0 mm.

On the contrary, if $l$ is large, the puncture failure becomes difficult to be induced, so that it is possible to make $t$ thin and to make L relatively large. But, if $t$ becomes thinner, the puncture failure tends to be easily induced, so that L becomes gradually small. For example, when $l$ is given by 0.2 mm $< l \leqq$ 0.4 mm, in the case that $t$ is 0.9 mm, L is given by 1.0 mm to 4.5 mm and in the case that $t$ is 0.7 mm, L is given by 1.0 mm to 3.5 mm and in the case that $t$ is 0.5 mm, L is given by 1.0 mm to 2.5 mm.

Figure 6:
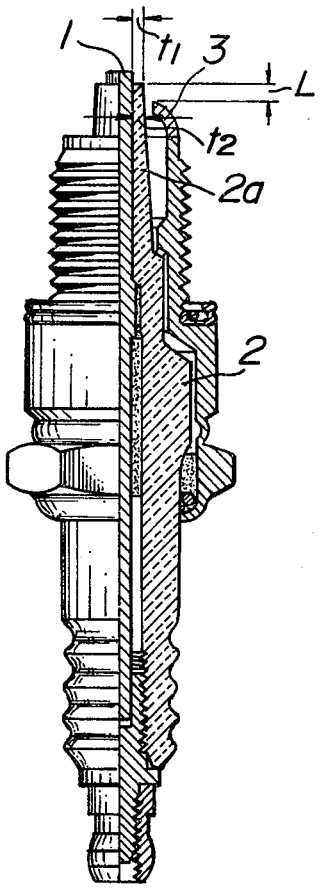
FIG. 6 is a front elevational view of another embodiment of a long distance discharge gap type spark plug according to the invention, one half being shown in section.

In FIG. 6 is shown another embodiment of a long distance gap type spark plug according to the invention. In the present embodiment, the firing portion 2a of the porcelain insulator 2 tapers to its front end. Particularly, the thickness $t_1$ of the front end of the firing portion 2a is made within a range of 0.3 mm to 0.8 mm and the thickness $t_2$ of that portion of the firing portion 2a which is opposed to the grounded electrode 3 is made within a range of 0.5 mm to 0.9 mm. The measure described ensures an effective countermeasure of preventing the puncture failure due to the spark discharge and provides the important advantage that the discharge voltage can effectively be reduced.

In addition, experimental tests have yielded the result that if the front end of the firing portion 2a of the porcelain insulator 2 is made round into an arcuate-shaped end having a radius $r$ which is at most equal to the thickness $t_1$ of the front end of the firing portion 2a of the porcelain insulator 2, the discharge voltage can be reduced in a further efficient manner.

Figure 7:
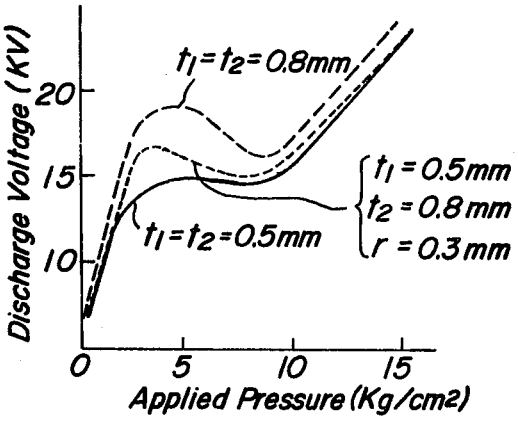
FIG. 7 is an explanatory graph showing the available discharge voltage in accordance with the invention as a function of the applied pressure for the tapered firing portion as compared with those for the elongated firing portion.

In FIG. 7 is shown the discharge voltage as a function of the applied pressure of at most 15 kg/cm$^2$ of the spark plug according to the invention which makes use of the tapered firing portion 2a having dimensions that $t_1 = 0.5$ mm, $t_2 = 0.8$ mm and $r = 0.3$ mm as compared with the cylindrical diameter portions having dimensions of $t_1 = t_2 = 0.5$ mm and $t_1 = t_2 = 0.8$ mm, respectively. In FIG. 7, the surface gap L is made 3 mm. As seen from FIG. 7 the tapered firing portion 2a can generally reduce the discharge voltage under all the applied pressure range if compared with the cylindrical firing portion 2a and particularly can reduce the discharge voltage in the same manner as in the case of the thin cylindrical firing portion 2a dimensioned as $t_1 = t_2 = 0.5$ mm under the applied pressure range of at least 5 kg/cm$^2$ without inducing any puncture failure at that portion of the firing portion 2a which is opposed to the grounded electrode 3.

As stated hereinbefore, the long distance discharge gap type spark plug which makes use of the back electrode effect according to the invention has its surface gap L whose dimension is determined by the mutual relation thereof with the minor air gap $l$ and the thickness $t$. As a result, the provision of the surface gap L of longer than 1.0 mm may improve the ignition property and prevent the firing portion 2a of the porcelain insulator 2 from being punctured, thereby providing a spark plug having an excellent durability.

What is claimed is:

1. In a long distance discharge gap type spark plug comprising a center electrode, a porcelain insulator surrounding said center electrode and provided at its lower side with a firing portion composed of a reduced diameter trunk wall made integral with said porcelain insulator, said firing portion extending up to near the lower end of said center electrode and exposing said lower end, and a grounded electrode opposed through said trunk wall to said center electrode, the improvement comprising a surface gap L formed between the front end of said center electrode and said grounded electrode and given by $1.0 \text{ mm} \leqq L \leqq 4.5 \text{ mm}$, a minor air gap $l$ formed between the outer peripheral surface of said firing portion and said grounded electrode and given by $0 \leqq l \leqq 0.6$ mm, and a thickness $t$ of the trunk wall of said firing portion given by $0.5 \text{ mm} \leqq t \leqq 0.9 \text{ mm}$, said surface gap L being determined within a range that satisfies the following conditions, i.e.

$L \leqq 5t + 2.0$ mm when $0.4 \text{ mm} < l \leqq 0.6$ mm, $L \leqq 5t$ when $0.2 \text{ mm} < l \leqq 0.4$ mm, $L \leqq 5t - 1.5$ mm when $0 < l \leqq 0.2$ mm, and $L \leqq 5t - 2.5$ mm when $l = 0$.

2. The spark plug according to claim 1, wherein the firing portion of said porcelain insulator surrounding said center electrode tapers to its front end and has the gradual diminution in thickness that the thickness $t_1$ at the front end is 0.3 mm to 0.8 mm, the thickness $t_2$ at the trunk wall opposed to the grounded electrode is 0.5 mm to 0.9 mm, and $t_1 < t_2$.

3. The spark plug according to claim 2, wherein the front end of the firing portion of said porcelain insulator is made round into an arcuate-shaped end having a radius $r$ which is at most equal to the thickness $t_1$ of the front end of the firing portion of said porcelain insulator.

* * * * *